US006910307B1

(12) United States Patent
Maurer

(10) Patent No.: US 6,910,307 B1
(45) Date of Patent: Jun. 28, 2005

(54) ARCHITECTURAL MOLDING

(76) Inventor: Scott D. Maurer, 16 Hidden Valley, Rocky River, OH (US) 44116

( * ) Notice: Subject to any disclaimer, the term of this patent is extended or adjusted under 35 U.S.C. 154(b) by 0 days.

(21) Appl. No.: 09/337,243

(22) Filed: Jun. 22, 1999

(51) Int. Cl.[7] ..... E04F 19/04
(52) U.S. Cl. ..... 52/287.1; 52/717.03; 52/717.05
(58) Field of Search ..... 52/287.1, 288.1, 52/717.05, 717.03, 716.1

(56) References Cited

U.S. PATENT DOCUMENTS

| | | | | |
|---|---|---|---|---|
| 3,200,547 A | * | 8/1965 | Johnson | 52/287.1 |
| 3,216,164 A | | 11/1965 | Stillman | |
| 3,302,350 A | | 2/1967 | Brown et al. | |
| 3,408,250 A | * | 10/1968 | Finefrock | 52/287.1 |
| 3,481,092 A | | 12/1969 | Constantino | |
| 3,616,587 A | | 11/1971 | Schlafly, Jr. | |
| 3,619,343 A | * | 11/1971 | Freeman | 52/309.6 |
| 3,922,408 A | | 11/1975 | Smith | |
| 3,958,373 A | * | 5/1976 | Stewart et al. | 52/58 |
| 4,091,586 A | | 5/1978 | Schwartz | |
| 4,117,782 A | | 10/1978 | Cahill | |
| 4,246,303 A | | 1/1981 | Townsend | |
| 4,277,526 A | | 7/1981 | Jackson | |
| 4,315,390 A | | 2/1982 | Schaafsma | |
| 4,546,021 A | | 10/1985 | Mears | |
| 4,546,022 A | | 10/1985 | Madonia et al. | |
| 4,567,091 A | * | 1/1986 | Spector | 428/317.1 |
| 4,601,149 A | | 7/1986 | Dokan | |
| 4,760,681 A | | 8/1988 | Harrison | |
| 4,877,673 A | * | 10/1989 | Eckel et al. | 52/717.05 |
| 4,973,371 A | | 11/1990 | Parker | |
| 5,065,972 A | | 11/1991 | Buckshaw et al. | |
| 5,199,237 A | | 4/1993 | Juntunen | |
| 5,208,084 A | | 5/1993 | Rutz | |
| 5,212,923 A | | 5/1993 | Pelosi et al. | |
| 5,330,814 A | | 7/1994 | Fewell | |
| 5,364,483 A | | 11/1994 | Zoller | |
| 5,372,869 A | | 12/1994 | Drexinger et al. | |
| 5,398,469 A | * | 3/1995 | Logan | 52/288.1 |
| 5,399,393 A | | 3/1995 | Zoller | |
| 5,421,371 A | | 6/1995 | Lauer | |
| 5,496,512 A | | 3/1996 | Logan | |
| 5,496,609 A | | 3/1996 | Michelstein | |
| 5,605,593 A | | 2/1997 | Lauer | |
| 5,661,929 A | | 9/1997 | Ross | |
| 5,662,753 A | | 9/1997 | Loos | |
| 5,705,002 A | | 1/1998 | Sherry | |
| 5,810,406 A | | 9/1998 | Reid, Jr. et al. | |
| 5,819,485 A | * | 10/1998 | Lane et al. | 52/287.1 |
| 5,863,369 A | | 1/1999 | Clarke et al. | |
| 5,902,642 A | * | 5/1999 | Horiki et al. | 427/282 |
| 5,918,435 A | | 7/1999 | McGowen | |
| 5,934,995 A | * | 8/1999 | Morris et al. | 52/199 |
| 5,996,300 A | * | 12/1999 | Hamlin | 52/559 |
| 6,083,613 A | * | 7/2000 | Hayashi et al. | 428/317.3 |
| 6,284,360 B1 | * | 9/2001 | Johnson et al. | 428/317.1 |

FOREIGN PATENT DOCUMENTS

| | | |
|---|---|---|
| JP | 5-141055 A | 6/1993 |
| JP | 6-156155 A | 6/1994 |

OTHER PUBLICATIONS

"Finishing Touches, Mouldings and Medallions", Armstrong, 1993, 5 pages.

* cited by examiner

*Primary Examiner*—Michael Safavi
(74) *Attorney, Agent, or Firm*—Hahn Loeser & Parks, LLP

(57) ABSTRACT

An architectural molding includes an extruded flexible plastic foam member having a front side, a rear side and a cross sectional profile. Also included is a layer of pressure sensitive adhesive affixed to at least a portion of the rear side and a release strip releasibly adhered to the layer of pressure sensitive adhesive.

7 Claims, 5 Drawing Sheets

ARCHITECTURAL MOLDING

BACKGROUND OF THE INVENTION

This invention relates to architectural molding installed at the base, mid-portion or top of an architectural wall and, in particular, to a molding composed of flexible plastic foam.

Decorative moldings are routinely used in architecture to provide decoration and to cover various raw edges and imperfections. Such moldings are most commonly made of wood, but other rigid materials have been employed. In general, such materials are relatively expensive and installation of the molding has required substantial skill as a workman.

U.S. Pat. No. 5,496,512 shows thin molded plastic (e.g., polystyrene) molding strips for application to walls. The molding strips rely on thinness to provide flexibility and are either vacuum or pressure molded. A central portion of the molding is attached to the wall and one or more of the edges of the molding are resiliently flexed into snug engagement with the wall. The molding is installed using overlapped joints. There is a need for more effective architectural molding and architectural molding which is easier to install.

SUMMARY OF THE INVENTION

An architectural molding includes an extruded flexible plastic foam member having a front side, a rear side and a cross sectional profile. Also included is a layer of pressure sensitive adhesive affixed to at least a portion of the rear side and a release strip releasibly adhered to the layer of pressure sensitive adhesive.

A method for installing the architectural molding to a structure includes providing the molding; removing a portion of the release strip to expose a portion of the pressure sensitive adhesive; adhering the exposed portion to the structure; flexing a portion of the molding not yet adhered to the structure away from the structure and removing an additional portion of the release strip to expose an additional portion of the pressure sensitive adhesive; and adhering the additional portion to the structure.

A tool for the application of an architectural molding between a wall and a ceiling, where the molding has a front side, a rear side and a cross sectional profile. The tool includes a ceiling following surface; a wall following surface; a profile following surface; and a handle, the handle providing a manual grip for sliding the tool along a wall and ceiling intersection and the profile following surface providing pressure resistive support to a central portion of the profile, while permitting respective outer portions of the profile to be pressed against the wall and the ceiling.

A method for installing the architectural molding between a wall and a ceiling using the tool is also provided. The method includes placing the tool against the intersection; removing a portion of the release strip to expose a wall portion and a ceiling portion of the pressure sensitive adhesive; placing the central portion against the profile following surface and adhering the wall portion to the wall and the ceiling portion to the ceiling; flexing a portion of the molding not yet adhered to the wall or ceiling away from the wall or ceiling, respectively, and removing an additional portion of the release strip to expose an additional portion of the pressure sensitive adhesive; sliding the tool to cooperate with the flexed portion; and adhering the additional portion of the pressure sensitive adhesive to the wall or ceiling.

An architectural molding adapter includes an elongate sheet of plastic material having a back side and a front side; a plurality of longitudinal fold grooves in the sheet; a pressure sensitive adhesive affixed to longitudinal peripheral portions of the back side; and a release strip releasibly adhered to the pressure sensitive adhesive, the adapter being adapted to provide an intermediate attachment point for multiple rows of crown molding when the adapter is folded along a plurality of the fold grooves into a generally rectangular cross section structure when attached to a wall and ceiling.

A method for installing multiple rows of pressure sensitive adhesive backed crown molding using the adapter is also provided.

DESCRIPTION OF THE PREFERRED EMBODIMENTS OF THE INVENTION

When a range such as 5–25 is given, this means preferably at least 5 and preferably not more than 25.

Figure 1:
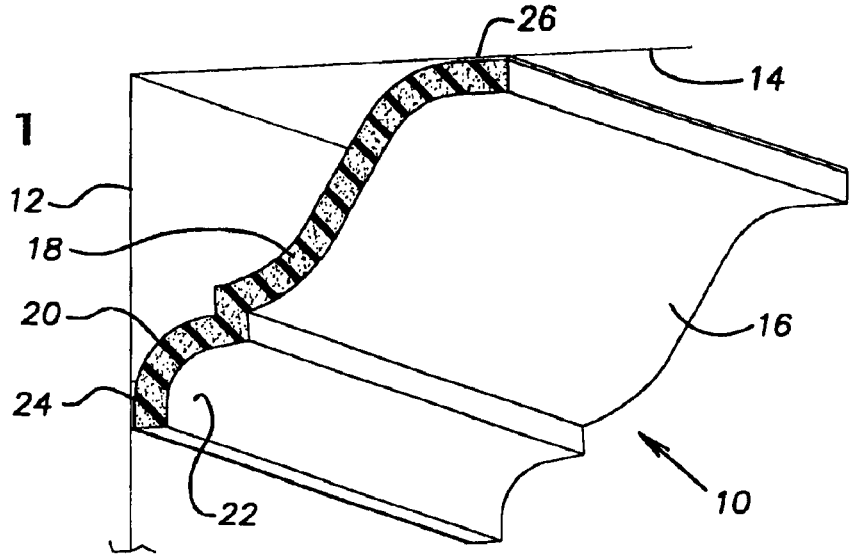
FIG. 1 is a cross sectional perspective view of an installed molding according to the invention for a top portion of a wall.

Referring to FIG. 1, an architectural molding 10 is shown installed between a top portion of a wall 12 and the edge of a ceiling 14. Moldings at this location are often referred to as crown moldings. The molding 10 includes an extruded flexible plastic foam member 16 having a cross section or cross sectional profile 18 and a rear side or surface 20 and a front side or surface 22. The front side or surface 22, when viewed in cross section (such as looking down the longitudinal length of the molding), determines the front surface profile of the molding. Correspondingly, the rear side or surface 20 determines or defines a rear surface profile. In the preferred embodiment, the cross sectional profile 18 is constant along the longitudinal direction of the member 16; that is, if you look at the cross sectional profile 18 every few feet as you travel down the length of member 16, the profile 18 will remain the same.

Figure 7:
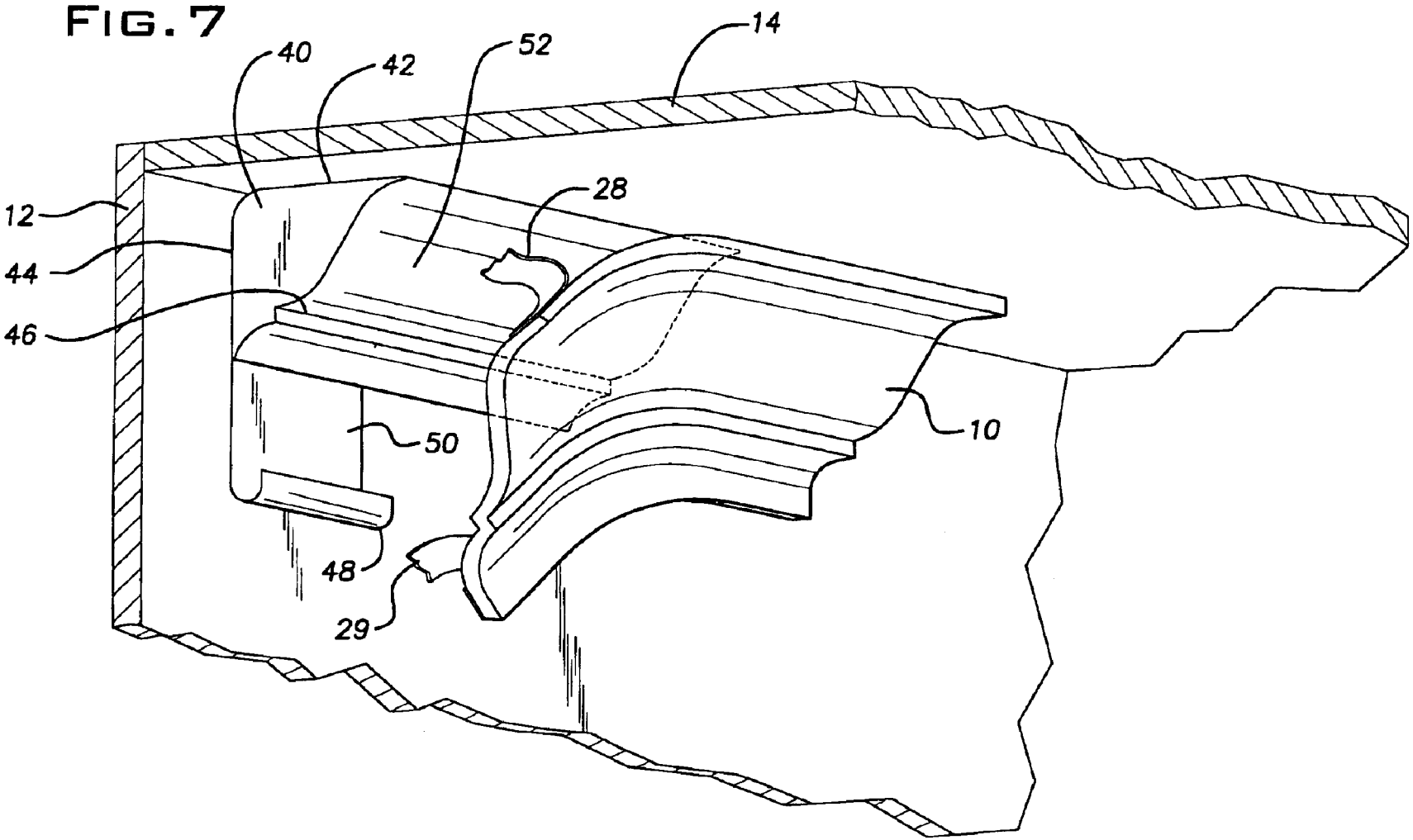
FIG. 7 is a perspective view showing a tool in use for installing molding according to the invention.

The member 16 is provided with one or more layers of pressure sensitive adhesive. For example, pressure sensitive adhesive layers 24, 26 may be affixed on the rear side 20 on outer or edge portions of the molding 10 that will contact the wall or ceiling. Referring to FIG. 7, a release strip 28, 29 is initially adhered to each area or layer of pressure sensitive adhesive to protect the adhesive until installation of the molding 10.

The member 16 is extruded in continuous lengths having a constant cross sectional profile 18. The extrusion process ordinarily results in a constant, unchanging cross sectional profile. FIG. 1 illustrates a compound cove crown molding (see the front surface profile). Other types of moldings having a continuously constant or uniform cross section and front surface profile can be utilized, such as, the following types of molding (these being determined by the front surface profile): crown, cove, fillet and fascia, torus, reeding, cavetto, scotia, conge and beak. Various front surface profiles for crown and cove moldings can be used, such as those illustrated in molding catalogues from Hiland Wood Products, Walnut Creek, Ohio and American Hardwood, Columbia Station, Ohio, which are known in the art and which are incorporated herein by reference. The member 16 is preferably a low density, closed cell, thermoplastic flexible foam that is resiliently compressible and resiliently flexible. The flexible plastic foam preferably has a density of 1.6–3, more preferably about 2, lbs. per cubic foot, preferably less than 9, 7, 6, 5, 4 and 3 lbs./cu. ft. The flexible foam is resilient and can be easily bent and compressed and will then return to its original shape. The flexible plastic foam is preferably polyethylene, rubber latex, polypropylene, polyurethane, polyvinyl chloride or polyolefin flexible plastic foam, more preferably polyethylene flexible plastic foam, preferably made with an isobutane blowing agent. The extruded flexible plastic foam is preferably polyethylene, less preferably substantially or principally or predominantly polyethylene or the major proportion of which is polyethylene. Such polyethylene foams are available as Nomafoam from Nomaco, Inc., Zebulon, NC.

The layer of pressure sensitive adhesive 24, 26 may be applied to the member 16 either while member 16 is being made or at a later time. In the preferred embodiment, the adhesive may be, for example, a hot melt pressure sensitive adhesive applied hot (such as 350° F.) to the member 16 and becoming affixed thereto as the adhesive cools. A suitable adhesive is available from H. B. Fuller Company, St. Paul, Minn., as HL-8209 DR. Preferably, the pressure sensitive adhesive is high heat resistant, permanent grade with a 180 degree peel (60 sec./75 F, 1 mil.) of at least 5, more preferably at least 6 or 7, lbs./inch, polyken tack of at least 1500 grams, loop tack of at least 50, 70 or 90 ounces. The release strips 29, 28 are releasibly adhered to the adhesive 24, 26, respectively. It is also possible to affix the adhesive in other ways, such as applying the adhesive to the release strip and then applying the adhesive/release strip from web-like rolls.

The member 16 may be pre-colored to desired colors by adding coloring to the plastic foam material prior to extruding. This produces a front side 22 suitable for use without further painting, coating, etc.

One may also apply a primer to the front side 22 either during manufacturing (pre-primed) or at the job site to make the molding 10 paintable (including techniques such as "wood-graining"). A primer such as Chil-Perm CP-30 from Childers Products Company may be used. The primed surface may then be painted.

It is also possible to treat the front surface 22 with corona charge for corona treatment. This electrostatic treatment allows paint to adhere directly to the surface 22 without a primer coating. Alternatively the front surface can be treated with corona charge in-line at the manufacturing facility, and a flexible and quick dry paint or primer can also be applied in-line.

In the preferred embodiment, the molding 10 is produced, packaged and sold in at least 30 foot lengths and, typically, in lengths of at least 50, 75, 100 and 120 feet. The profile 18 is typically in the range of 3/16–3/4, more preferably 1/4–1/2, more preferably about 3/8, inch in thickness (and 2 to 8 or 3 to 6 or about 4.5 inches wide, that is, from the tip near layer 24 to the tip near layer 26). This thickness allows segments of the molding 10 to be joined with either butt or mitered joints. The molding 10 can be accurately cut with a cutting guide such as a miter guide with a hand-held serrated knife. The thickness of the molding 10, when cut, provides a wide attachment face or bonding surface for butt or miter joints to product precise uniform attachments. The thickness also may be chosen to provide sufficient strength to span the space between the wall 12 and the ceiling 14. The resilience of the molding 10 promotes tight joints. The joints may be glued with a suitable adhesive (e.g., FD-8133 manufactured by H. B. Fuller Company) or heat bonded.

Figure 4:
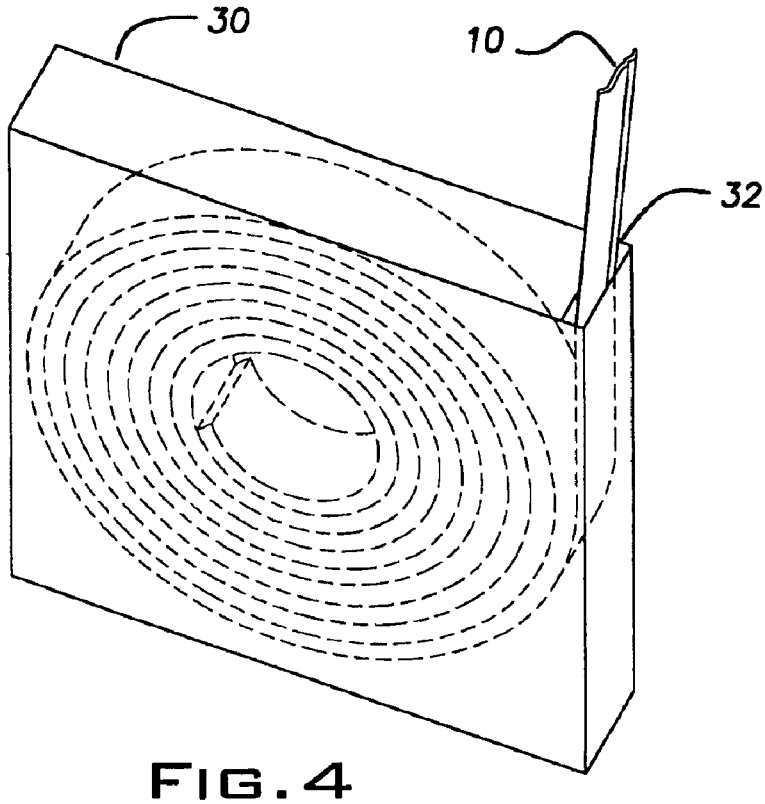
FIG. 4 is a perspective view of a package containing a molding according to the invention.

Referring to FIG. 4, the molding 10 may be packaged in rolls within a box 30 such as a cardboard box. An opening or slot 32 in the box 30 may be used to dispense the molding 10 as it is installed. For example, in the case of 4.5 inch wide crown molding, a 30×30×5 inch box can hold at least 120 feet of the molding 10. The weight of such a package and molding combined would typically be less than 6 pounds. Preferably, the front side 22 of the molding 10 faces the inside of the roll (as shown in FIG. 4) to facilitate installation. Preferably, the molding 10 comes out of the box "right-handed", that is, as it comes out of the box you start on the right side of the wall and work to the left. During this process the molding comes out of the box properly oriented so that the top of the molding is against the ceiling and the bottom is against the wall. In this way the molding is coming out of the box "right-handed". FIG. 4 shows the molding 10 coming out of the box "left-handed".

Figure 5:
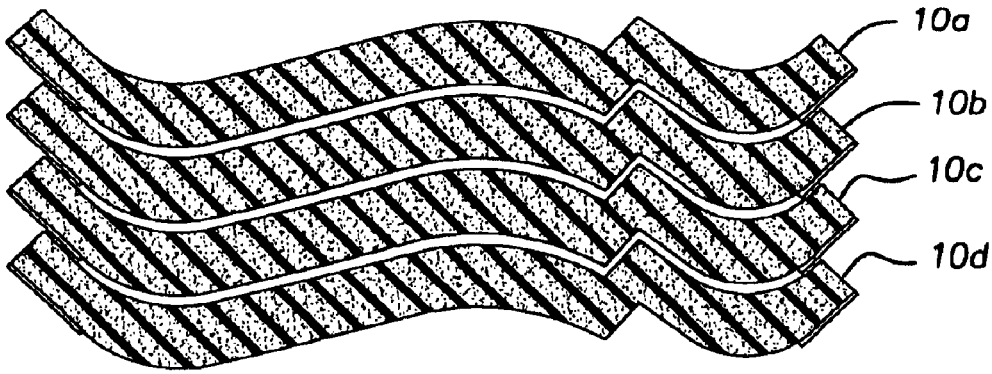
FIG. 5 is a cross sectional longitudinal elevation view of nested layers of molding according to the invention.

Referring to FIG. 5, the profile of the molding 10 may be advantageously chosen to provide nesting between the layers 10*a*, 10*b*, 10*c*, 10*d* of a roll of the molding 10. This nesting maximizes the amount of the molding 10 in a given roll diameter and minimizes the likelihood of creases in the surface of the molding 10. Preferably, nesting is achieved by providing a front surface profile which matches or substantially matches or matches in significant portions the rear surface profile. Typically this will result when the cross sectional profile 18 is of substantially or generally uniform thickness.

Referring to FIGS. 1 and 7, the molding 10 may be installed by removing a portion of the release strips 28, 29 to expose portions of the pressure sensitive adhesive 24, 26. The exposed portions are then adhered to the ceiling/wall structure and a portion of the molding 10 that is not yet adhered to the structure is flexed away from the structure and more of the release strips 28, 29 are removed to expose an additional portion of the adhesive 24, 26. The additional exposed portions are then adhered to the structure.

Typically, it may be desirable to apply an aesthetic coating such as paint to the molding 10 after it is adhered to the structure.

Figure 6:
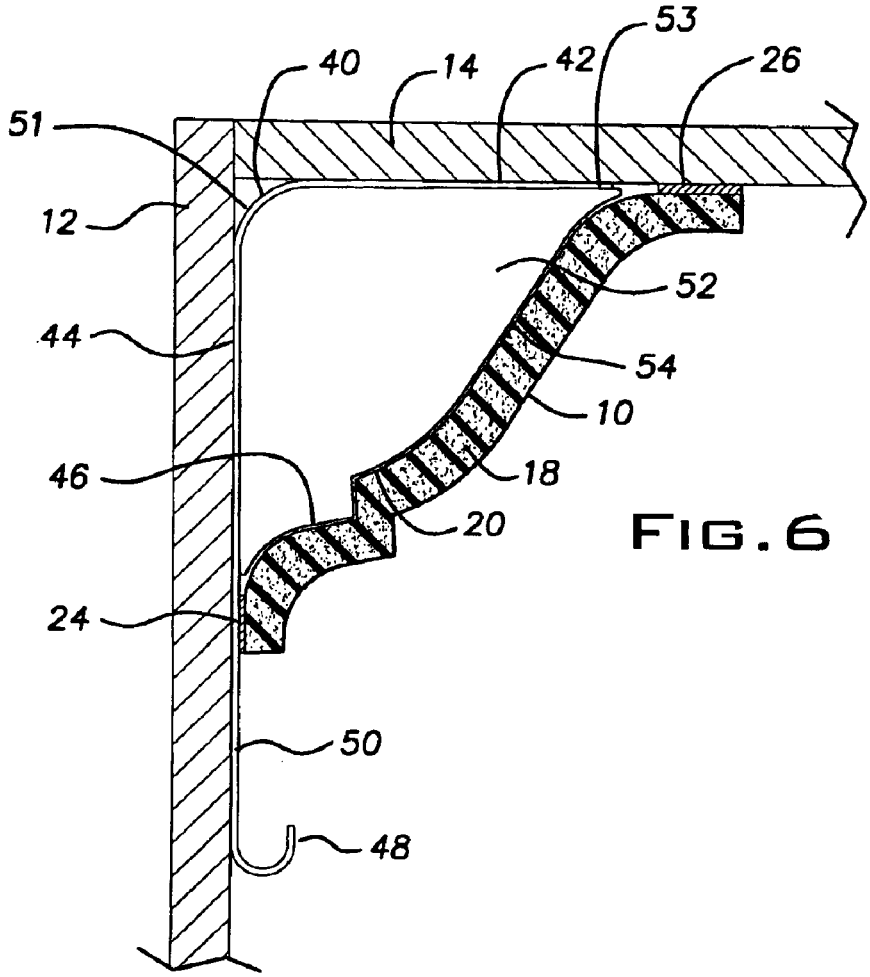
FIG. 6 is a longitudinal elevation view (with many elements shown in cross section) showing a tool in use for installing molding according to the invention.

Referring to FIGS. 6 and 7, a tool 40 for easier installation of the molding 10 includes a ceiling following surface 42, a wall following surface 44, a profile following surface 46 and a handle 48. In the preferred embodiment, the tool 40 is formed from an element 50 having a generally right angle cross section. The element 50 may be formed from, for example, a sheet of metal or rigid plastic and is preferably of constant width as shown in FIG. 7. With reference to FIG. 6, the element 50 extends from the handle 48 upward to the curved portion 51 and across to near the tip 53 of the tool 40. The element 50 has a first outside surface corresponding to the surface 42 and a second outside surface corresponding to the surface 44. A block of plastic foam 52 (preferably flexible polyethylene foam.) attached to the inside surfaces of the element 50 provides the surface 46. The surface 46 matches the contour of the central portion 54 of the rear side 20 of the profile 18. Less preferably the portion of element 50 corresponding to surface 42 may be omitted and block 52 may be of other materials such as solid plastic. The tool 40 is shaped so that the two tips (one of which is tip 53) do not stick out far enough to contact the pressure sensitive adhesive 24, 26.

The handle 48 is provided by an extension from the element 50. The handle 48 is shown extending from the surface 44, but it is also possible to extend from the surface 42.

In use, the tool 40 is manually grasped by the handle 48 and the tool placed against the intersection of the wall 12 and the ceiling 14. A portion of the release strips 28, 29 is removed to expose portions of the pressure sensitive adhesive 24, 26. The central portion 54 is placed against the surface 46. This guides the molding 10 into the correct position relative to the wall 12 and the ceiling 14 and provides pressure resistive support to the central portion 54 while allowing the manual pressing of the adhesive 24, 26 against the wall 12 and ceiling 14, respectively.

The exposed portions are adhered to the wall 12 and the ceiling 14, respectively, and a portion of the molding 10 that is not yet adhered to the wall or ceiling is flexed away from the wall or ceiling and more of the release strips 28, 29 are removed to expose additional portions of the adhesive 24, 26. The tool 40 is slid and repositioned to cooperate with the flexed portion as the flexed portion is positioned by the surface 46 for adhering. The additional exposed portions are then adhered to the wall 12 and the ceiling 14. In this manner the tool 40 is progressively slid along the top of the wall and a long continuous length of molding 10 is adhered in place.

Figure 2:
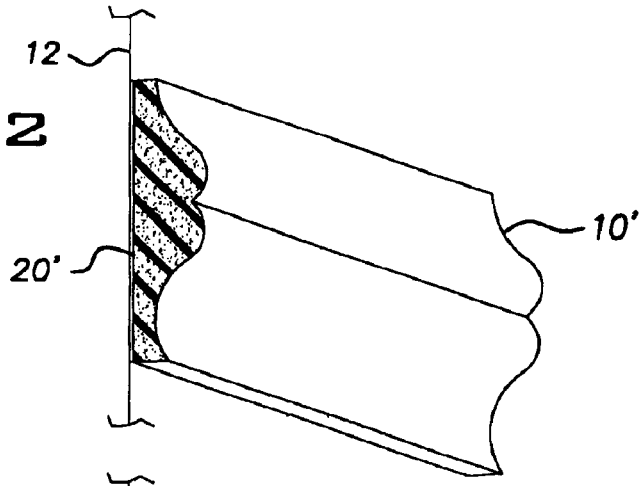
FIG. 2 is a cross sectional perspective view of an installed molding according to the invention for a mid-portion of a wall.

Referring to FIG. 2, a molding 10' similar to the molding 10 of FIG. 1 is shown installed on a mid-portion of the wall 12. Moldings at this location are often referred to as chair rails. The rear side 20' of the molding 10' is generally flat and like the molding 10, is provided with pressure sensitive adhesive (unshown) for adhering the molding 10' to the wall 12. The molding 10' may be manufactured and packaged the same way as the molding 10 and installed similarly. In uninstalled form, the molding 10' is also provided with at least one release strip.

Figure 10:
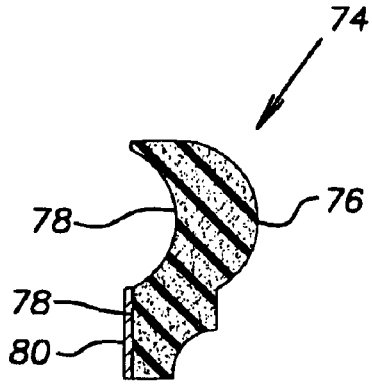
FIG. 10 is a cross sectional view of a molding according to the invention.

A preferred chair rail or panel molding 74 is shown in FIG. 10, which is designed for convenient nesting. Molding 74 (preferably 1.5 inches from top to bottom) has a front surface 76 and a rear surface 78, the lower flat portion of which is coated with a layer of pressure sensitive adhesive 80 for adhesion to a wall.

Figure 3:
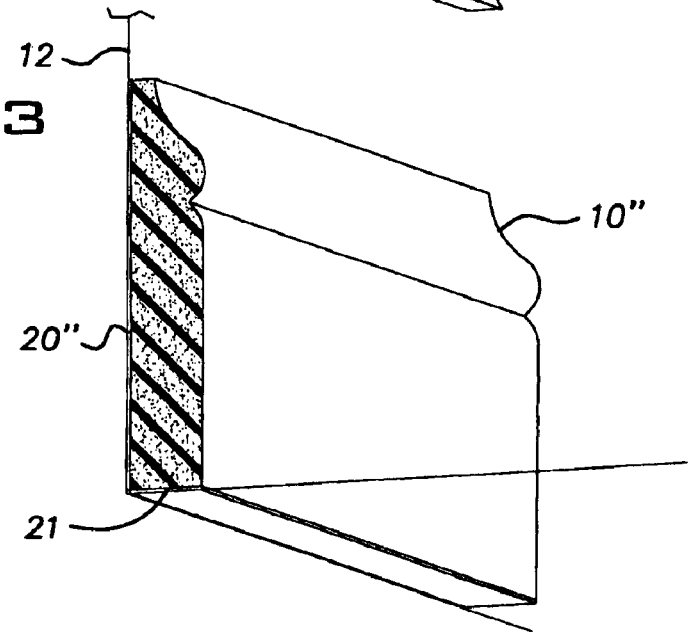
FIG. 3 is a cross sectional perspective view of an installed molding according to the invention for a base portion of a wall.

Referring to FIG. 3, a molding 10" similar to the molding 10 of FIG. 1 is shown installed on a base portion of the wall 12. Moldings at this location are often referred to as base molding or baseboard molding. The rear side 20" of the molding 10" is generally flat and like the molding 10, is provided with pressure sensitive adhesive (unshown) for adhering the molding 10" to the wall 12. Pressure sensitive adhesive may be applied along the entire rear side 20", or in strips, such as strips along the top, middle and bottom of side 20". Pressure sensitive adhesive may also be applied along the bottom surface 21 of molding 10". The molding 10" may be manufactured and packaged the same way as the molding 10 and installed similarly. In uninstalled form the molding 10" is also provided with a release strip over each strip of pressure sensitive adhesive. Other front surface profiles for chair rail moldings and base moldings can be used, such as those illustrated in molding catalogues from Hiland Wood Products, Walnut creek, Ohio and American Hardwood, Columbia Station, Ohio, which are incorporated herein by reference.

Figure 8:
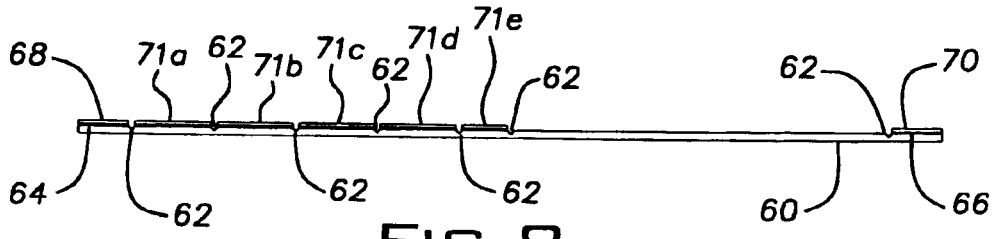
FIG. 8 is a longitudinal elevation view or end view of an adapter for installing multiple rows of molding according to the invention.
Figure 9:
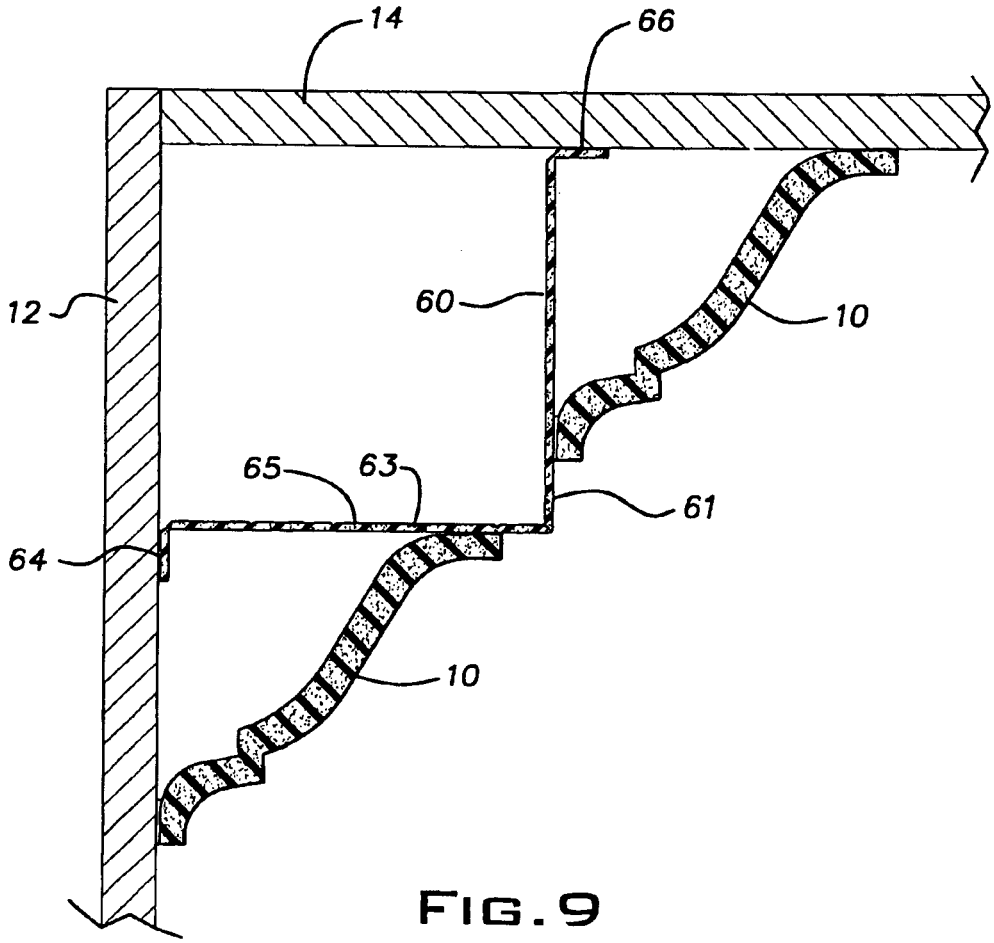
FIG. 9 is a cross sectional longitudinal elevation view of the adapter of FIG. 8 in use with moldings according to the invention.

Referring to FIGS. 8 and 9, an adapter or stepform 60 for applying multiple rows of the moldings 10 is shown. The adapter or stepform 60 is an elongate sheet, for example 6 to 18 inches wide, from 1/16 to 1/2 , more preferably 1/4 to 5/16 or 3/8, inches thick and of any convenient length, such as at least 30, 50, 75, 100 or 120 feet. The adapter 60 is preferably of the same flexible plastic foam material as the member 16, except preferably a little more dense; preferably having a density of 1.6–9, more preferably 2–6, more preferably 3–4, more preferably about 3, lbs. per cubic foot. Less preferably it is a plastic material which is resilient, flexible and coilable, such as solid or lightweight plastic. The adapter may be, for example 8 inches wide and 3/8 inch thick and have a series of longitudinal scoring or fold grooves 62. The grooves 62 may be on either the front or back side or both, preferably the back. The grooves are spaced to provide convenient selection of spacing between folds, for example, 1/2 or 3/4 inch to accommodate various combinations of molding sizes. The peripheral portions of the back side of the adapter 60 are provided with pressure sensitive adhesive 64, 66 and release strips 68, 70, respectively. Other strips or layers of pressure sensitive adhesive (with release strips), such as illustrated at 71*a*, 71*b*, 71*c*, 71*d* and 71*e*, may optionally be added longitudinally between each pair of adjacent grooves 62. The adapter 60 is manufactured and packaged in rolls as described above and installed with a tool like tool 40 except that the profile following surface 46 is shaped to correspond to the shape of the adapter 60 as installed.

In use, the adapter 60 is folded on desired grooves 62 to form a generally rectangular cross section (in combination with the wall 12 and the ceiling 14), preferably 3.5×3.5 inches. Release strips 68, 70 are removed and, using a tool 40, the adapter 60 is attached to the top portion of the wall 12 and to the edge portion of the ceiling 14. Then as described above and using tool 40, a crown molding or molding 10 is attached between the adapter 60 and the ceiling 14. Another row of molding 10 is attached between the wall 12 and the adapter 60. In this way, the adapter 60 serves as an intermediate attachment point for the rows of moldings and permits a much larger and more complex total molding surface to be installed. Note how a portion 61 of the adapter 60 forms a portion of the exposed molding surface. If the adapter 60 is folded further away from the adhesive (such as at location 63) so that a flat portion of adapter 60 between 64 and 63 is against the wall, the adapter 60 may also be stapled to the wall at location 65 for extra support. Alternatively, a layer of pressure sensitive adhesive, such as at 71*a*, 71*b*, 71*c*, 71*d* or 71*e*, on the adapter 60 (with release strip removed) may serve the function of the staple.

The moldings disclosed herein are much less expensive than those of materials such as wood. Because the molding is light and flexible, it can be quickly installed with few tools. No unsightly nail holes are created and no sawing is required because the molding can be cut with a sharp knife. This also lowers the level of skill required for installation.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An architectural molding for mounting at the intersection of a wall and a ceiling, comprising:

an intersection of a wall and ceiling, wherein the wall and ceiling are substantive orthogonal to one another, a single extruded monolithic closed cell plastic foam member mounted at the intersection of the wall and the ceiling, the foam member having a front side including a decorative front surface profile, a rear side, a first longitudinally extending outer edge between the front side and the rear side, a second longitudinally extending outer edge between the front side and the rear side and spaced from the first longitudinally extending outer edge and forming a central portion therebetween, and the plastic foam member being resiliently compressible and resiliently flexible;

a first layer of adhesive affixed to a first portion of the rear side adjacent the first longitudinally extending outer edge; and a second layer of adhesive affixed to a second portion of the rear side adjacent the second longitudinally extending outer edge, the second layer of adhesive being oriented about perpendicular to the first layer of adhesive, wherein one of the first and second layers of adhesive is attached to the wall and the other layer of adhesive is attached to the ceiling;

the plastic foam member being supported in a position such that the central portion extends between the wall and ceiling and is spaced from the intersection of the wall and the ceiling without deformation of the shape thereof.

2. The architectural molding according to claim 1, wherein said front side is corona treated to accept paint.

3. The architectural molding according to claim 1, wherein said front side is pre-primed to accept paint.

4. The architectural molding according to claim 1, wherein said plastic foam member is made of a material selected from the group consisting of polyethylene, rubber latex, polypropylene, polyurethane and polyvinyl chloride.

5. The architectural molding according to claim 1, wherein said plastic foam member is made of polyethylene foam.

6. The architectural molding according to claim 1, wherein said plastic foam member has a density of less than 9 lbs./cu. ft.

7. The architectural molding according to claim 1, wherein the decorative front surface profile is a crown molding profile.

* * * * *